US009422696B2

(12) United States Patent
Sansum et al.

(10) Patent No.: US 9,422,696 B2
(45) Date of Patent: Aug. 23, 2016

(54) FLUID CONNECTORS

(75) Inventors: Nigel Paul Sansum, Quedgeley (GB); Richard William Dauncey, Tewkesbury (GB); Christopher Ian Thompson, Bristol (GB)

(73) Assignee: KOHLER MIRA LIMITED (GB)

( * ) Notice: Subject to any disclaimer, the term of this patent is extended or adjusted under 35 U.S.C. 154(b) by 706 days.

(21) Appl. No.: 13/641,842

(22) PCT Filed: Apr. 21, 2011

(86) PCT No.: PCT/GB2011/050810

§ 371 (c)(1),
(2), (4) Date: Oct. 17, 2012

(87) PCT Pub. No.: WO2011/135345

PCT Pub. Date: Mar. 11, 2011

(65) Prior Publication Data

US 2013/0036547 A1 Feb. 14, 2013

(30) Foreign Application Priority Data

Apr. 26, 2010 (GB) ..... 1006898.9

(51) Int. Cl.
*E03C 1/042* (2006.01)
*E03C 1/04* (2006.01)

(52) U.S. Cl.
CPC ..... *E03C 1/042* (2013.01); *E03C 1/0403* (2013.01); *Y10T 137/0447* (2015.04); *Y10T 137/6977* (2015.04)

(58) Field of Classification Search
CPC ..... E03C 1/04; E03C 1/042
USPC ..... 4/675–677
See application file for complete search history.

(56) References Cited

U.S. PATENT DOCUMENTS 1,824,492 A 9/1931 Morris

FOREIGN PATENT DOCUMENTS

| | | | |
|---|---|---|---|
| BE | 822119 | A1 | 3/1975 |
| DE | 2512979 | A1 | 10/1975 |
| EP | 0266296 | A1 | 5/1988 |
| WO | WO2010/038036 | A1 | 4/2010 |

OTHER PUBLICATIONS

International Search Report and Written Opinion for International Application No. PCT/GB2011/050810, date of mailing Jul. 15, 2011, 11 pages.

*Primary Examiner* — Tuan N Nguyen
(74) *Attorney, Agent, or Firm* — Foley & Lardner LLP

(57) ABSTRACT

A system is provided for mounting a mixing valve on a support surface to connect the mixing valve (101) to supply pipes (109, 111) projecting from the support surface. The system includes a mounting plate (103) for securing to the support surface so that the supply pipes (109, 111) pass through openings in the mounting plate (103). Sleeves (159, 161) fit over the projecting ends of the supply pipes (109, 111) for reception in inlets of the mixing valve (101) to thereby compress the sleeves (159, 161) to grip and retain the pipes (109, 111) in the inlets. The mixing valve (101) is releasably secured to the mounting plate (103) allowing the mixing valve (101) to be detached and the sleeves (159, 161) and mounting plate (103) to be removed from the pipes (109, 111).

13 Claims, 14 Drawing Sheets

FLUID CONNECTORS

CROSS-REFERENCE TO RELATED APPLICATIONS

The present application is a U.S. National Stage Application of International Application No. PCT/GB2011/050810 filed Apr. 21, 2011, which claims the benefit of and priority to Great Britain Patent Application No. 1006898.9 filed Apr. 26, 2010. The entire disclosures of International Application No. PCT/GB2011/050810 and Great Britain Patent Application No. 1006898.9 are incorporated herein by reference.

This invention relates to fluid connectors for connecting a supply pipe to a fitting. The invention has particular, but not exclusive application for connecting a mixing valve to supply pipes for hot and cold water.

Conventional mixing valve design requires two pipes to extrude through the wall surface which are then attached to the mixing valve using compression nuts and olives. These usually have pipe concealing plates to hide the hole for the pipe and the edges of cut tiles.

The mixing valve is usually attached to the wall surface using a mounting or backplate via screws into wall plugs (depending on wall type). This has the disadvantage that the olives compress onto the pipes preventing future removal of the nuts, olives and pipe concealing plates. A further disadvantage is that the mixing valve has a large footprint.

The present invention has been made from a consideration of the foregoing and seeks to mitigate the aforementioned disadvantages.

According to a first aspect of the invention, there is provided a mixing valve assembly comprising a mixing valve having inlets for supply pipes for hot and cold water, a mounting plate for securing to a support surface such that the supply pipes extend through the mounting plate for reception in the inlets, wherein the mixing valve is releasably connectable to the mounting plate, and the assembly further comprises means co-operable with the inlets to secure releasably the supply pipes and wherein the pipe securing means and mounting plate can be removed from the supply pipes when the mixing valve is detached from the mounting plate.

The securing means is positionable on the supply pipes and co-operable with the inlets in response to reception in the inlets to grip and secure releasably the supply pipes in the inlets.

The securing means may comprise sleeves that are a sliding fit on the pipes and are compressed by engagement with the inlets to secure the pipes when fitting the valve. The sleeves are released when the valve is detached and can be removed from the pipes together with the mounting plate.

Preferably, the mounting plate conceals the pipe entry holes and the sleeves are slidable over the ends of the pipes so as to extend into the inlets when the valve is attached to the mounting plate. This allows the valve, sleeves and mounting plate to be removed completely at a later date and provides a smaller foot print for the valve.

Preferably, the sleeves are made of a material such as plastics and are resilient so as to return towards their original shape when the valve is disconnected from the mounting plate and release the pipes so that the sleeves and mounting plate can be removed from the pipes. The sleeves may be integral with the mounting plate or separate from the mounting plate.

In some forms, each sleeve is separate from the mounting plate and comprises a cylindrical body with an external flange at one end that may locate against the mounting plate and the body is received in and co-operates with the inlet to secure the pipe and prevent the pipe being pushed back through the opening in the mounting plate.

In other forms, each sleeve is integral with the mounting plate and comprises a cylindrical body that is received in and co-operates with the inlet to secure the pipe and prevent the pipe being pushed back through the opening in the mounting plate.

In one arrangement, the inlets are provided within the valve body. Preferably, the inlets are a push fit on the pipes and a fluid-tight seal is provided between the pipes and the valve body within the inlets. For example sealing members such as O-rings may be located within the inlets to seal against the outer or inner surface of the pipes. Preferably, the valve body is releasably secured to the mounting plate and conceals the mounting plate. For example, the valve body may be secured by means of a retainer, such as a locking pin or grub screw that may be inserted through an opening in the valve body to engage the mounting plate to secure releasably the valve body to the mounting plate. Alternatively, the retainer may comprise a detent such as a tongue, clip or lug on one of the valve body and mounting plate that engages the other to secure releasably the valve body to the mounting plate. The detent may engage with a snap action to provide a positive indication that the valve body has been secured to the mounting plate.

In another arrangement, the inlets are provided by inlet connectors. Preferably, the inlet connectors fit over the pipes and a fluid tight seal is provided between the pipes and the inlet connectors within the inlets. For example sealing members such as O-rings may be located within the inlets to seal against the outer or inner surface of the pipes.

In one embodiment, the inlet connectors are releasably attached to the mounting plate by engagement of screw threads on the mounting plate and inlet connectors. In this embodiment, the inlet connectors are preferably rotatable relative to the valve body to attach and detach the valve body. Alternatively or additionally, the valve body may be detachable from the inlet connectors.

In another embodiment, the inlet connectors are a push-fit on the pipes and releasably secured to the mounting plate. For example, the inlet connectors may be secured by means of retainers, such as clamps. The valve body may be detachable from the inlet connectors.

Preferably, a fluid tight seal is provided between the pipes and the mounting plate. For example the pipes may pass through openings in the mounting plate and sealing members such as O-rings may be located within the openings to seal against the pipes.

The seals between the pipes and the mounting plate preferably provide a back-up to the seals between the pipes and the inlets. As a result, any fluid that leaks past the seals within the inlets is prevented from passing back along the pipes into the support surface where it may remain undetected for a period of time sufficient to cause damage to the support surface or surrounding structure.

Preferably the inlets are in the form of bores in the valve body or in the inlet connectors. The bores may be of uniform cross-section, i.e. cylindrical, producing a substantially constant gripping force as the sleeves move further into the bores. Alternatively, the bores may increase in cross-section towards the outer end, i.e. taper, producing an increased gripping force as the sleeves move further into the bores.

According to a second aspect of the invention, there is provided a method of connecting supply pipes for hot and cold water to inlets of a mixing valve, the method comprising the steps of providing a mounting plate with holes for passage of the pipes, attaching the mounting plate to a support surface so that the pipes pass through the holes and project from gripping means positionable on the projecting ends of the pipes, inserting the projecting ends of the pipes into inlets of the mixing valve so that the gripping means co-operates with the inlets to secure the pipes, and connecting the mixing valve to the mounting plate.

Preferably, the gripping means comprises sleeves that are slidable on projecting ends of the pipes and co-operate with the inlets to compress the sleeves to grip the pipes. The compression force is released when the inlets are detached from the pipes allowing the sleeves to be slid off the pipes and the mounting plate removed. The sleeves may be separate from or integral with the mounting plate.

According to a third aspect of the invention, there is provided a fitting for connection to a water supply pipe, wherein the fitting has an inlet co-operable with means positioned on the pipe to grip and secure releasably the pipe when the pipe and gripping means are received in the inlet.

Preferably, the gripping means comprises a sleeve that is slidable on the pipe and co-operates with the inlet to compress the sleeve to grip the pipe. The compression force is released when the inlet is detached from the pipe allowing the sleeve to be slid off the pipe. The inlet may comprise a cylindrical bore or a tapered bore.

Preferably, the fitting is connectable to a mounting plate through which the pipe extends and the fitting is connectable to the mounting plate. The mounting plate can be attached to a support surface such as a wall to conceal entry of the pipe through an opening in the support surface.

Removal of the sleeve allows the mounting plate to be detached from the support surface and slid off the pipe. The sleeve may be separate from or integral with the mounting plate. The sleeve may take any of the forms described previously.

The fitting may be a mixing valve having separate inlets for supply pipes for hot and cold water and separate gripping means to secure each pipe.

According to a fourth aspect of the invention, there is provided a mounting plate for a mixing valve, the mounting plate being adapted for securing to a support surface and having openings adapted for passage of supply pipes for hot water and cold water in a fluid-tight manner for connection to a mixing valve.

Preferably, the mounting plate is provided with gripping means positionable on the supply pipes passing through the openings and co-operable with inlets of the mixing valve to grip and secure releasably the supply pipes in the inlets for connecting the supply pipes to the mixing valve.

The gripping means may comprise sleeves separate from or integral with the mounting plate as described previously. The sleeves are preferably compressed within the inlets to grip and secure the pipes. The sleeves may take any of the forms described previously.

Preferably, the openings are provided with seal members such as O-rings for sealing engagement with the supply pipes passing through the openings.

Preferably, the mounting plate is adapted for attaching a mixing valve having inlets for connection to the supply pipes passing through the openings. The mixing valve may be releasably attached to the mounting plate. The inlets may be provided by a body of a mixing valve or by inlet connectors connected to the body. The body may be secured by any of the means described previously.

According to a fifth aspect of the invention, there is provided a system for mounting a mixing valve on a support surface to connect inlets on the mixing valve to supply pipes projecting from the support surface, the system comprising a mounting plate for securing to the support surface so that the supply pipes pass through openings in the mounting plate, and retainers configured to fit over the supply pipes and co-operate, in use, with the inlets of a mixing valve attached to the mounting plate to grip the supply pipes.

Preferably, the mounting plate is adapted for releasably attaching the mixing valve such that the mounting plate and retainers can be removed from the supply pipes when the mixing valve has been detached.

Preferably, the supply pipes and retainers are received in the inlets and the retainers are compressed to grip the supply pipes. The retainer may be separate from or integral with the mounting plate.

The retainers may comprise sleeves through which the supply pipes extend. The sleeves may take any of the forms described previously.

The invention will now be described in more detail by way of example only with reference to the accompanying drawings in which.

Figure 1:
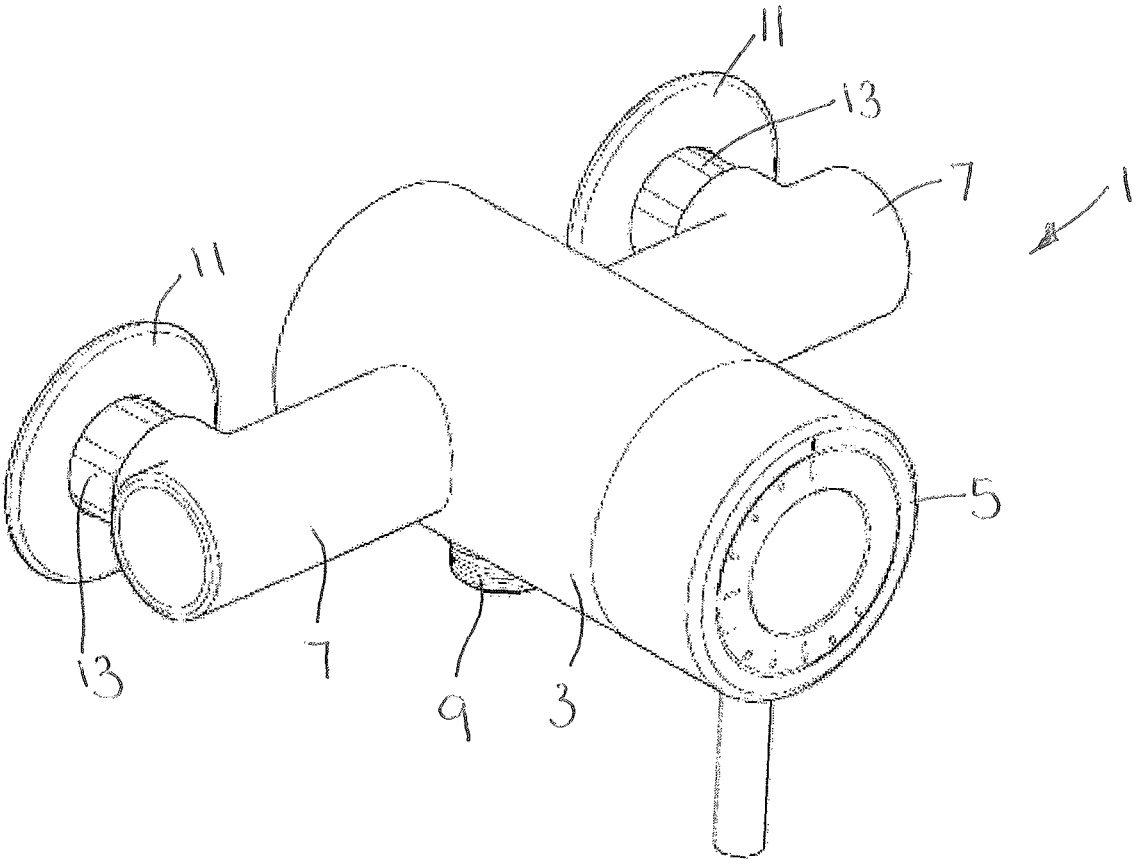
FIGURE 1 (PRIOR ART)
FIG. 1 shows a prior art installation of a mixing valve.

Referring first to FIG. 1 of the drawings, a typical prior art installation of a mixing valve 1 shown. The mixing valve 1 has a cylindrical body 3 housing a control valve (not shown)

coupled to a rotatable control knob 5 at the front end for starting/stopping water flow and selecting water temperature. The control valve may be thermostatic or non-thermostatic. The body 3 has a pair of inlet connectors 7 for connection to inlet pipes (not shown) for hot and cold water and an outlet connector 9 for connection to a flexible hose (not shown) or supply pipe (not shown) to deliver mixed water to an ablutionary fitting such as a shower handset (not shown) or shower head (not shown).

The rear end of the body 3 fits over and is releasably connected to a mounting plate (not shown) that is secured to a support surface (not shown) such as a wall. Holes (not shown) in the support surface for passage of the inlet pipes are covered by concealing plates 11 that fit over the inlet pipes and the inlet connectors 7 are secured to the inlet pipes by compression nuts 13 that compress olives (not shown) mounted on the inlet pipes to provide a fluid tight seal. When the mixing valve 1 is removed, the concealing plates 11 and compression nuts 13 are retained by the tight fit of the olives on the inlet pipes. This can complicate replacing the mixing valve if the compression nuts 13 do not fit the inlet connectors of the new mixing valve.

Referring now to FIGS. 2 to 7 of the drawings, there is shown installation of a mixing valve 101 according to a first embodiment of the invention. The mixing valve 101 is adapted for mounting on a wall or similar support surface 102 by means of a mounting plate 103.

The mounting plate 103 has the shape of an ellipse with two apertures 105, 107 for passage of water supply pipes 109, 111 for connecting the mixing valve 101 to supplies of hot and cold water. It will be understood the shape of the mounting plate 103 could be other than an ellipse. The mounting plate 103 is secured to the wall by screws or similar fixings (not shown) that pass through holes 113, 115 in the mounting plate. It will be understood that the number and position of the screw holes may be altered. The mounting plate 103 may be plastic or metal. The mounting plate may be used as a template to mark the positions on the wall 102 for entry of the pipes 109, 111 and for securing the plate 103 to the wall 102.

The mixing valve 101 has a body 117 housing a control valve 118 for mixing hot and cold water for delivery to an outlet 119 on the underside of the valve body 117. A rotary control knob 121 at the front end of the valve body 117 is operable to control the temperature and flow rate of the water delivered to the outlet 119.

The rear end of the body valve 117 is provided with a countersink 123 having the shape of an ellipse to receive the mounting plate 103. The depth of the countersink is such that the rear end of the valve body 117 locates against the wall 102 to conceal the mounting plate 103. It will be understood that the elliptical shape of the mounting plate 103 and countersink 123 in the valve body 117 is not limiting and that other shapes may be employed. Matching shapes for the mounting plate and countersink may assist location and alignment of the valve body on the mounting plate for installation purposes but it will be understood, this is also not limiting and the mounting plate and countersink may have non-matching shapes.

Figure 7:
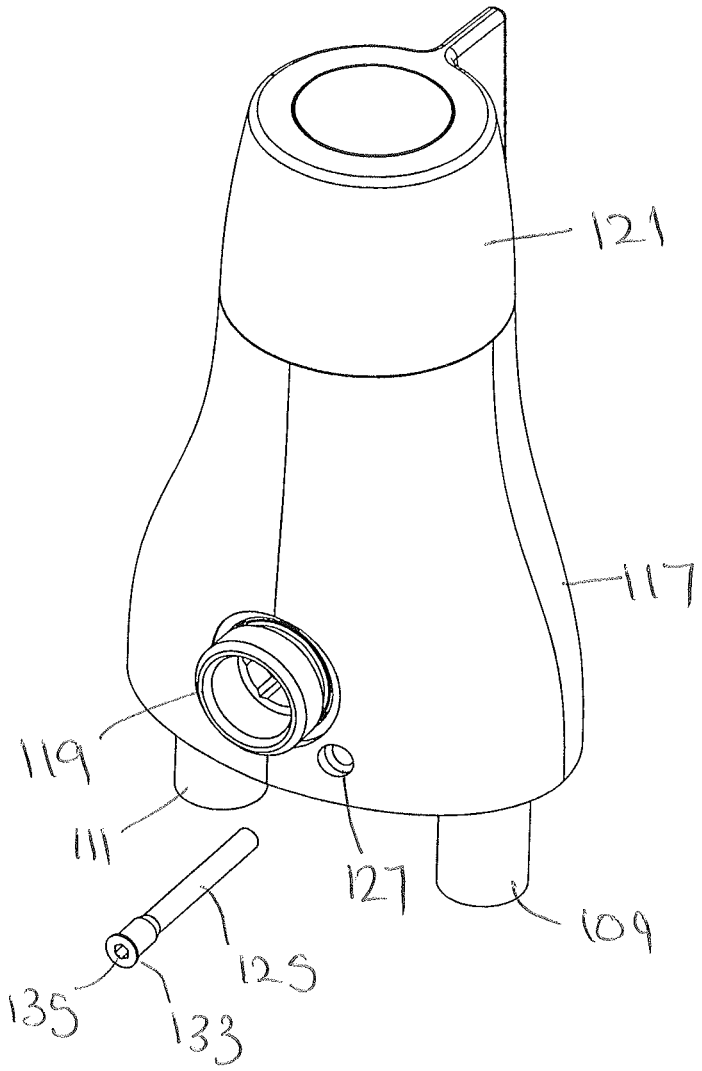
FIG. 7 shows the installed position of the mixing valve of FIG. 2 ready for inserting the locking pin to secure the mixing valve to the mounting plate.

The valve body 117 is releasably secured to the mounting plate 103 by means of a locking pin 125 (FIG. 7). The locking pin 125 is inserted through a hole 127 in the underside of the valve body 117 adjacent to the outlet 119 and through aligned holes 131 in two spaced flanges 129 on the mounting plate 103 to engage a threaded bore (not shown) in the valve body 117. The locking pin 125 has a head 133 with a recessed drive formation 135 that requires a tool with a matching formation to engage/disengage the locking pin 125 to prevent inadvertent or unauthorised removal of the valve body 117. Any other suitable means for releasably securing the valve body 117 to the mounting plate 103 may be employed such as a grub screw.

The rear end of the body 117 is also provided with a pair of axially extending inlets 137, 139 to receive the supply pipes 109, 111. The inlets 137, 139 are similar and one inlet will now be described in more detail with reference to FIG. 2, it being understood that the description applies to the other inlet.

The inlet 137 comprises a stepped bore having an inner end portion 141 and an outer end portion 143. The outer end portion 143 terminates in a shoulder 145 leading to the inner end portion 141. The inner end portion 141 is cylindrical and has an internal groove in which an elastomeric O-ring 147 is received. The outer end portion 143 is tapered to increase in diameter from the shoulder 145 towards the rear end of the valve body 117.

The inner end portions 141 of the inlets 137, 139 communicate with inlet chambers 149, 151 for delivery of hot and cold water to the control valve. In this embodiment, the control valve 118 is a shuttle valve having a valve shuttle 153 axially movable between hot and cold seats for controlling the relative proportions of hot and cold water delivered to a mixing chamber 155 communicating with the outlet 119. Also in this embodiment, a thermostat 157 responsive to the water temperature in the mixing chamber 155 is operable to adjust the position of the shuttle 153 to maintain a selected water temperature constant. Shuttle valves of this type are well known to those skilled in the art and are not further described herein. It will be understood that the control valve may be of any suitable type and may be thermostatic or non-thermostatic as well known to those skilled in the art.

Figure 4:
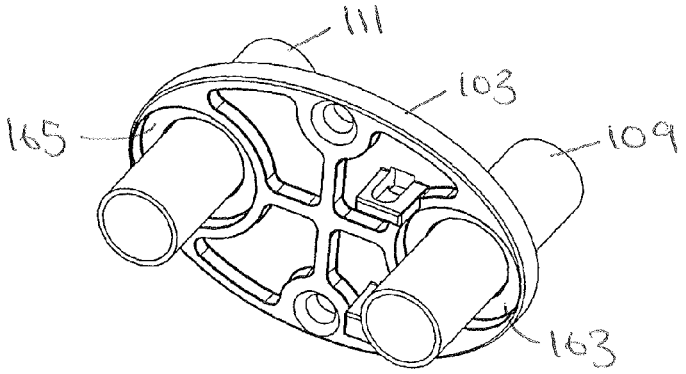
FIG. 4 shows the mounting plate of FIG. 3 and the inlet pipes for connection to inlets of the mixing valve of FIG. 2.
Figure 5:
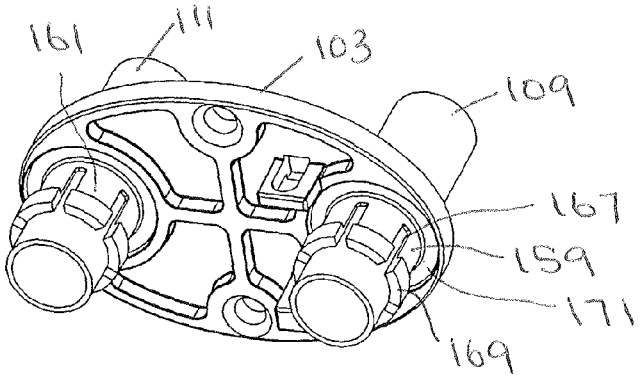
FIG. 5 shows the mounting plate and inlet pipes of FIG. 4 with sleeves for retaining the inlet pipes.

During installation, the mounting plate 103 is fitted over the supply pipes 109, 111 and secured to the wall so that the pipes 109, 111 project from the mounting plate 103 (FIG. 4). If necessary, the projecting length of the pipes 109, 111 can be reduced to allow fitment of the valve body 117. Sleeves 159, 161 are then fitted over the ends of the supply pipes 109, 111 projecting through the holes 105, 107 in the mounting plate 103 and slid along the pipes 109, 111 to seat in counterbores 163, 165 in the mounting plate 103 concentric with the holes 105, 107.

The sleeves 159, 161 are similar and have a cylindrical body sized to slide over the pipes. A plurality of slots 167 extend axially from one end of the body towards the other end. The body has an external collar 169 at one end that is split in the circumferential direction by the slots 167 and an external flange 171 at the other end. The slots 167 terminate before the flange 171. The flange 171 is of increased diameter relative to the collar 169. The sleeves 159, 161 may be made of plastics or other materials such as elastomers or metals.

Also during installation, the supply pipes 109, 111 are provided with filters 173, 175. The filters 173, 175 are similar and one filter will now be described in more detail with reference to FIG. 2, it being understood that the description applies to the other filter.

The filter 173 has a tubular sieve portion 177 that is a clearance fit in the end of the supply pipe 109 and a head portion 179 that is a close fit in the end of the supply pipe 109. The outer end of the head portion 179 is enlarged to be a radial tight fit in the inner bore portion 141. The tubular sieve portion 177 provides a large surface area for water to flow through so that there is a reduced risk of the filter 173 becoming blocked to restrict flow. The filters 173, 175 fit in the end of the supply pipes 109, 111 and can be removed for cleaning and/or replacement.

Figure 6:
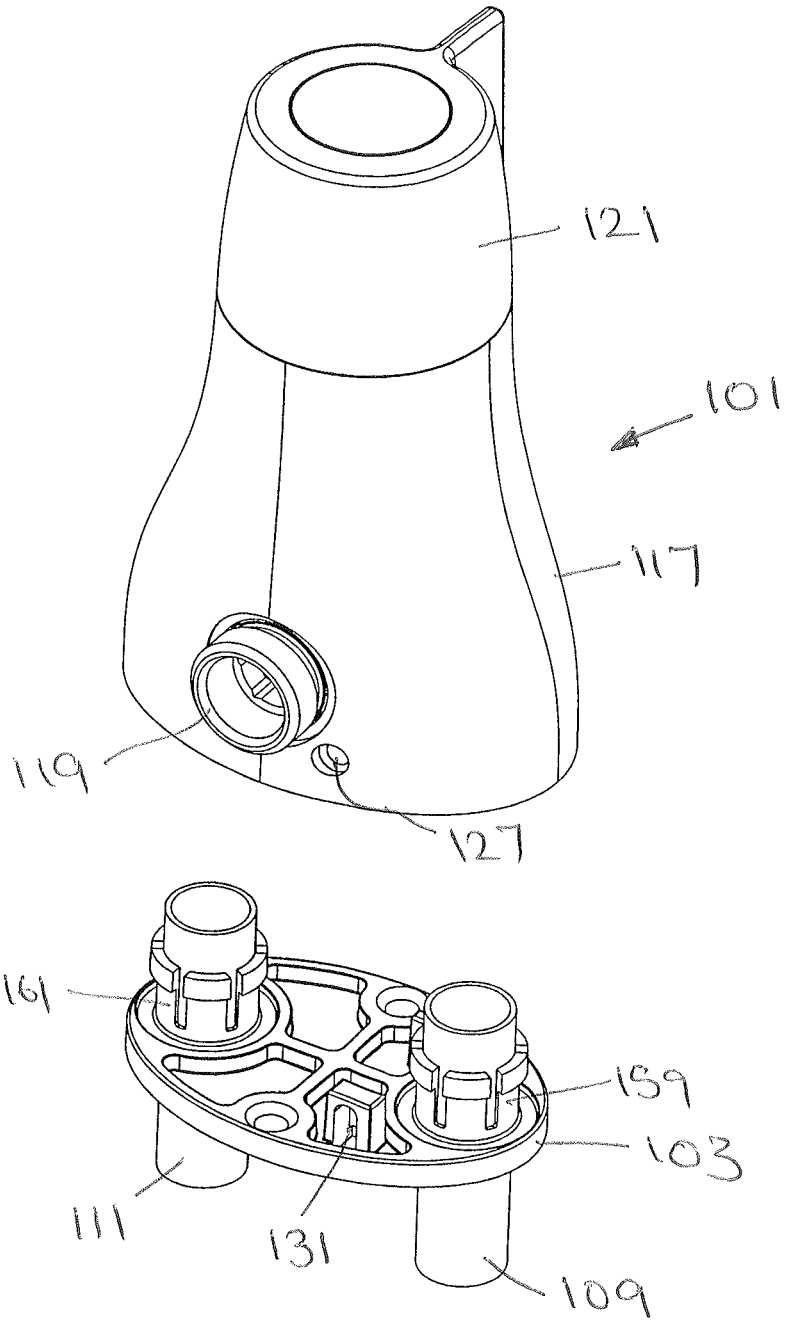
FIG. 6 shows the mounting plate, inlet pipes and sleeves of FIG. 5 ready for receiving the mixing valve of FIG. 2.

With the sleeves 159, 161 and filters 173, 175 in place, the valve body 117 is presented to the mounting plate 103 to align the inlets 137, 139 with the supply pipes 109, 111 (FIG. 6). The valve body 117 is then moved towards the mounting plate 103 to connect the supply pipes 109, 111 to the inlets 137, 139. Each connection is similar and one connection will now be described in more detail with reference to FIG. 2, it being understood that the description applies to the other connection.

The supply pipe 109 is received in the outer end portion 143 of the inlet 137 as the valve body 117 is pushed towards the mounting plate 103. The sleeve 159 is seated against the mounting plate 103 and is compressed radially inwards to grip the supply pipe 109 by engagement with the outer end portion 143 of the inlet 137 to prevent the supply pipe 109 being pushed back into the wall. As a result, the axial relationship between the sleeve 159 and the supply pipe 109 does not change as the valve body 117 is pushed towards the mounting plate 103 and the gripping force increases as the sleeve 159 extends further into the inlet 137 due to the taper of the outer end portion 143. In this way, the supply pipe 109 is firmly secured and retained within the inlet 137.

In the installed position (FIG. 2), the flange 171 at the end of the sleeve 159 is located between the mounting plate 103 and the valve body 117 and the end of the supply pipe 109 is received in the inner end portion 141 of the inlet 137 where the O-ring 147 provides a fluid-tight seal with the outer surface of the supply pipe 109 in the inner end portion 141. It will be understood that the supply pipe 111 is likewise firmly secured and retained in a fluid-tight manner within the other inlet 139 by a similar arrangement.

Figure 2:
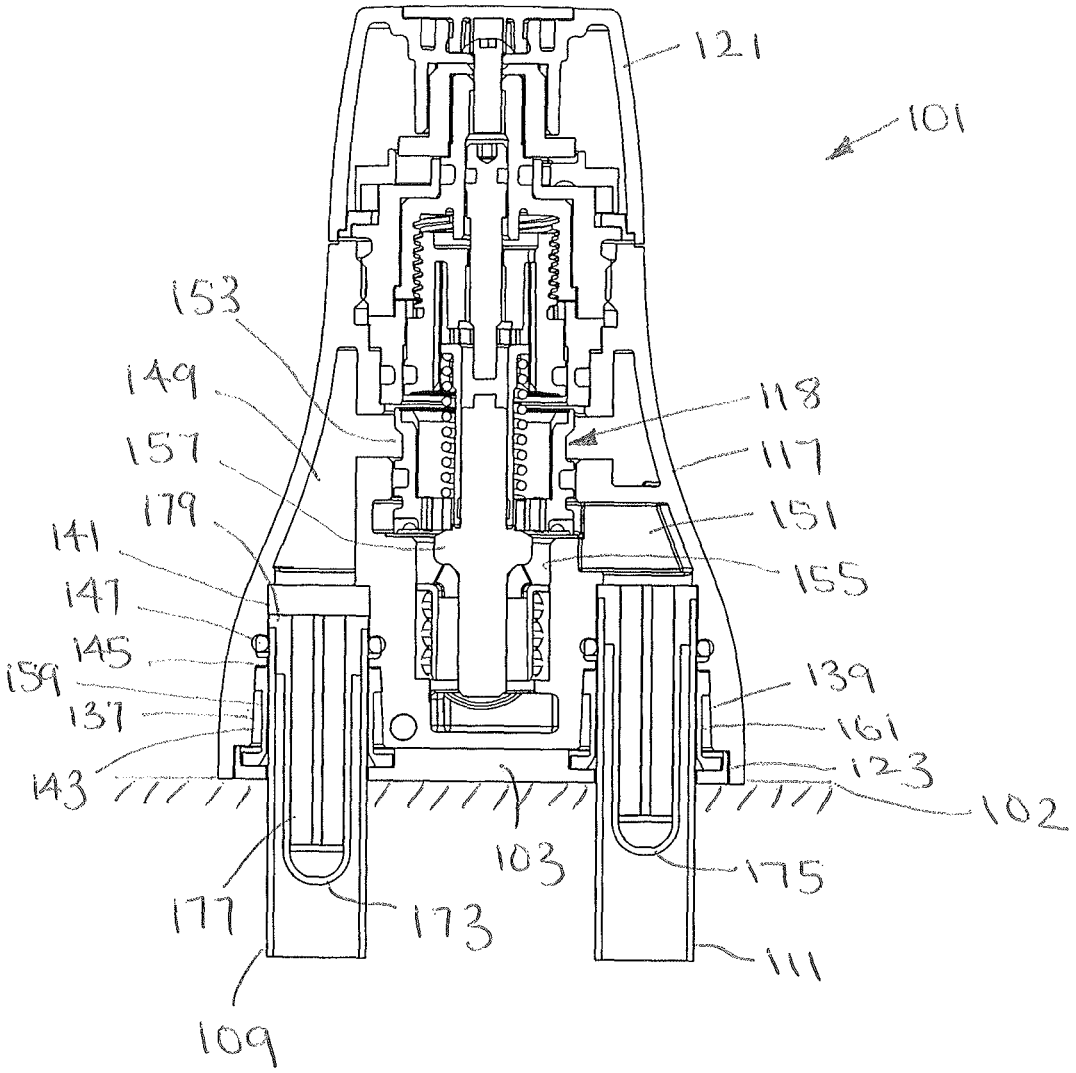
FIG. 2 is a longitudinal section through a mixing valve installation according to a first embodiment of the invention.
Figure 3:
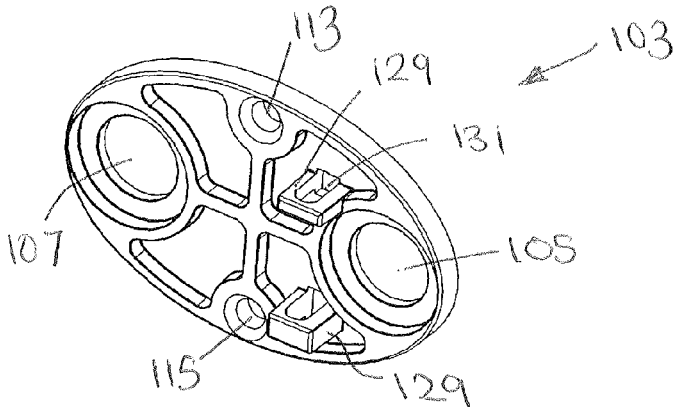
FIG. 3 is a perspective view of the mounting plate of the installation of FIG. 2.

The trimmed length of the supply pipes 109, 111 should be sufficient to ensure a fluid-tight seal with the O-rings 147 in the installed position of the mixing valve 101. Variations in the trimmed length of the supply pipes 109, 111 can be accommodated by the inner end portion 141 of the inlets 137, 139 as shown in FIG. 2 where the left hand side shows a minimum trimmed length and the right hand side shows a maximum trimmed length With the mixing valve 101 in position on the mounting plate 103, the locking pin 125 is inserted to secure the valve body 117 to the mounting plate and prevent the mixing valve 101 being detached from the mounting plate 103 (FIG. 7). When it is desired to remove the mixing valve 101, the locking pin 125 is removed and the valve 101 can be detached from the mounting plate 103. In a modification (not shown), the locking pin 125 may be replaced by any other means for releasably securing the mixing valve 101 to mounting plate 103. For example, the mounting plate 103 and valve body 117 may have co-operating formations which engage when the valve body 117 is fitted on the mounting plate 103 to secure the mixing valve 101 and which can be released to allow the valve body 117 to be removed from the mounting plate 103 when it is desired to detach the mixing valve 101. Suitable co-operating formations may comprise a projection on the mounting plate 103 such as a tongue, lug or clip that engages a recess within the valve body 117 when the valve body 117 is located on the mounting plate 103 to secure the mixing valve and that can be disengaged from the recess by inserting a tool through an opening in the valve body 117 to release the valve body 117 for detaching the valve 101 from the mounting plate 103. The formations may engage automatically as the valve body 117 is fitted on the mounting plate 103, for example with a snap or spring action that may provide an indication to the fitter that the valve body 117 has been correctly located and secured.

The compression of the sleeves 159, 161 is reduced as the valve body 117 is displaced away from the mounting plate 103 reducing the grip on the supply pipes 109, 111. When the valve 101 is detached from the mounting plate 103, the sleeves 159, 161 can be slid-off the pipes 109, 111 allowing the mounting plate 103 to be removed by releasing the screws attaching the mounting plate 103 to the wall 102 and leave the ends of the supply pipes 109, 111 projecting from the wall for mounting another mixing valve. By the use of sleeves 159, 161 to secure and retain the supply pipes 109, 111 in the inlets 137, 139 when the mixing valve 101 is installed, removal and replacement of the mixing valve 101 is facilitated. In a modification (not shown), the sleeves 159, 161 may be integral with the mounting plate 103.

Figure 8:
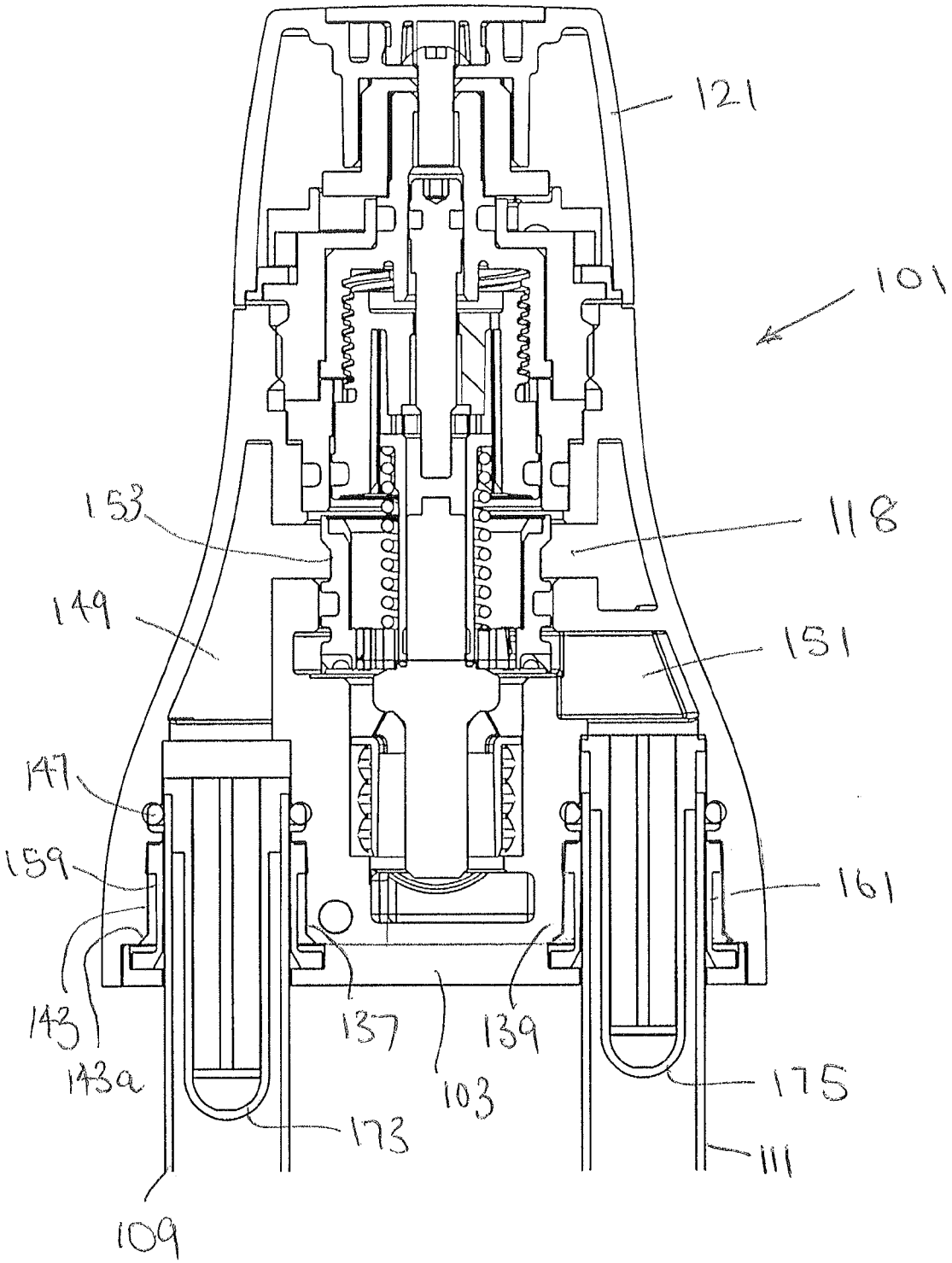
FIG. 8 is a longitudinal section showing a modification to the mixing valve of FIG. 2.

Referring now to FIG. 8 of the drawings, there is shown a modification to the mixing valve of FIGS. 2 to 7 in which like reference numerals are used to indicate corresponding parts.

As shown, the inlet 137 is modified so that the outer end portion 143 is cylindrical with a chamfer 143*a* at the entry end to assist initial compression of the sleeve 159. With this arrangement, the gripping force is substantially unchanged as the valve body 117 is pushed towards the mounting plate 103 so that the sleeve 159 extends further into the inlet 137 and the supply pipe 109 is firmly secured within the inlet 137. The outer end portion of the inlet 139 is likewise cylindrical with a chamfer at the outer end and the supply pipe 111 is secured in the inlet 139 in similar manner. In other respects, the construction and operation of the mixing valve and mounting plate is the same as the embodiment of FIGS. 2 to 7 and may include any of the modifications thereof.

Figure 9:
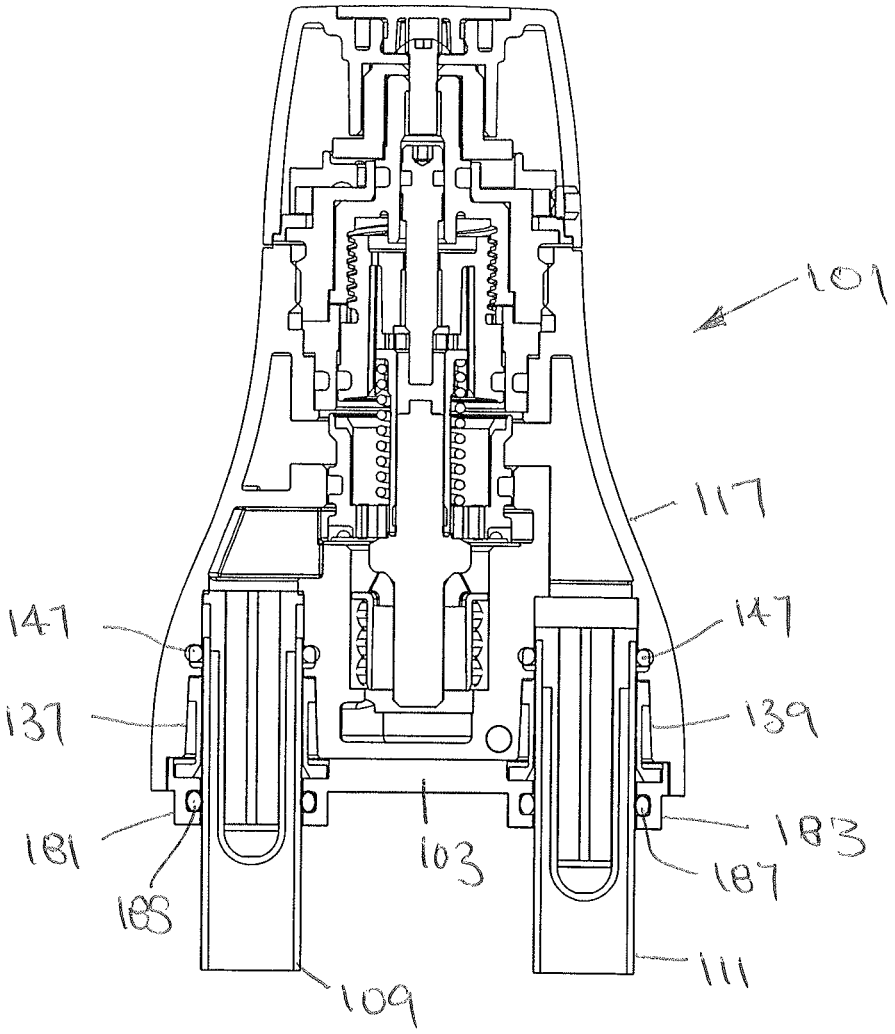
FIG. 9 is a longitudinal section showing a modification to the mounting plate of FIG. 3.
Figure 10:
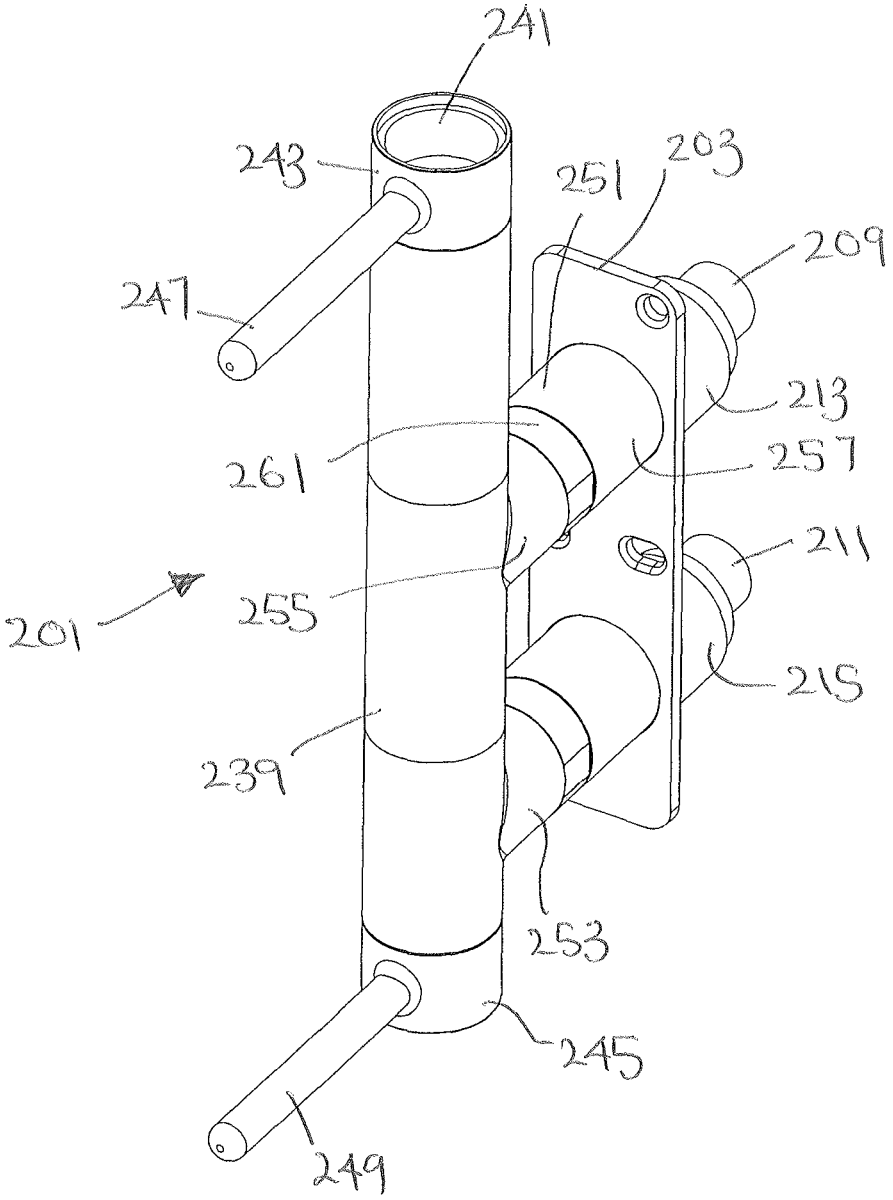
FIG. 10 is perspective view of a mixing valve installation according to a second embodiment of the invention.
Figure 11:
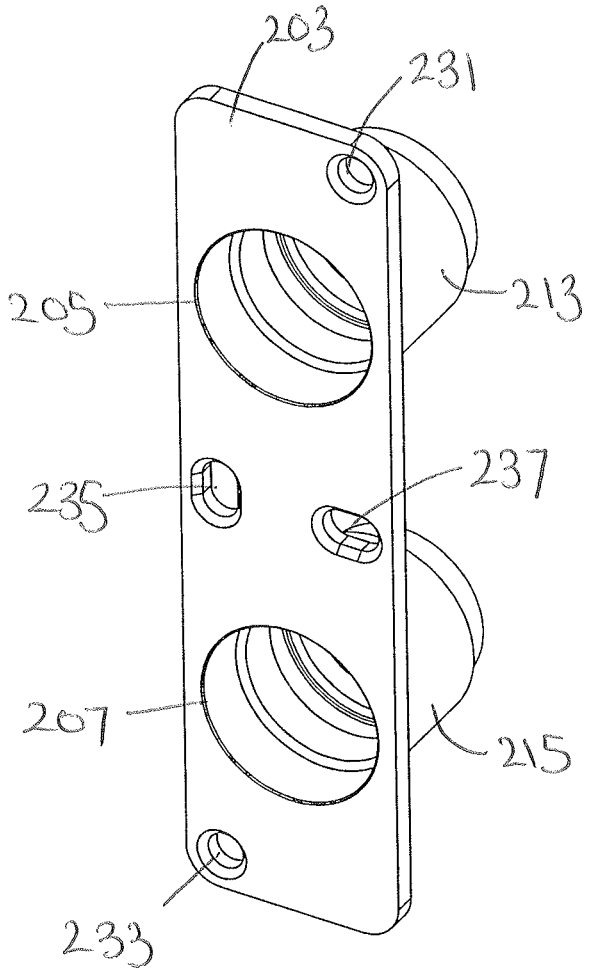
FIG. 11 is a perspective view of the mounting plate of the installation of FIG. 10.

Referring now to FIG. 9 of the drawings, there is shown a modification to the mounting plate of FIGS. 2 to 7 in which like reference numerals are used to indicate corresponding parts.

As shown, the mounting plate 103 is provided on the underside with two bosses 181, 183 concentric with the holes 105, 107. The bosses 181, 183 are received in the openings in the support surface for passage of the supply pipes 109, 111 so that the mounting plate 103 locates against the support surface. The supply pipes 109, 111 extend through the bosses 181, 183 and are sealed relative to the mounting plate 103 by O-rings 185, 187 that are located in internal annular grooves within the bosses 181, 183. These O-rings 185, 187 provide second or back-up seals to the first or main seals provided by the O-rings 147 within the inlets 137, 139. As a result, any fluid that leaks past the O-rings 147 is prevented from passing back along the supply pipes 109, 111 through the openings in the support surface where such leakage may remain concealed from view for a period of time until evidence of the leak is apparent. Instead, the fluid is confined to work its way between the mounting plate 103 and the valve body 117 to appear at the rear edge of valve body 117 on the outside of the support surface so as to be visible and allow appropriate remedial action to be taken before appreciable damage is caused within the support surface and the adjacent structure of the building. In other respects, the construction and operation of this mixing valve and mounting plate is the same as the embodiment of FIGS. 2 to 7 and may include any of the modifications thereof such as shown in FIG. 8.

Referring now to FIGS. 10 to 14 of the drawings, there is shown installation of a mixing valve 201 according to a second embodiment of the invention. The mixing valve 201 is adapted for mounting on a wall or similar support surface (not shown) by means of a mounting plate 203.

The mounting plate 203 is rectangular with two apertures 205, 207 for passage of water supply pipes 209, 211 for connecting the mixing valve 201 to supplies of hot and cold water. The apertures 205, 207 are defined by cylindrical bosses 213, 215 on one side of the mounting plate 203. Each boss 213, 215 is similar and one boss will now be described in more detail with reference to FIG. 12, it being understood that the description applies to the other boss.

The boss 213 has a stepped bore 217 having a first bore portion 219 that terminates in a shoulder 221 leading to a second bore portion 223 of reduced diameter. The second bore portion 223 has an internal annular groove 225 in which an O-ring (not shown) is located to provide a fluid tight seal with the outer surface of the supply pipe 209. The supply pipe 209 is a clearance fit in the first bore portion 219 and defines an annular gap 227 therewith. The first bore portion 219 is provided with an internal screw thread 229 intermediate the ends.

The mounting plate 203 is secured to the wall by screws or similar fixings (not shown) that pass through holes 231, 233, 235, 237 in the mounting plate. The holes 235, 237 are elongated in directions normal to one another to allow limited adjustment to be made to the position of the mounting plate 203 on the wall. When secured, the bosses 213, 215 extend behind the mounting plate 203 into holes or openings (not shown) provided in the wall for entry of the supply pipes 209, 211. The mounting plate 203 extends over and conceals the holes or openings. The mounting plate 203 may be plastic or metal. It will be understood that the mounting plate 203 may be rectangular as shown or any other shape for concealing the holes or openings in the wall, for example round, elliptical or the like.

The mixing valve 201 has a cylindrical body 239 housing a control valve (not shown) for mixing hot and cold water for delivery to an outlet 241 at one end of the valve body 239. Rotary control members 243, 245 provided at the ends of the valve body 239 are operable by means of levers 247, 249 to control the flow rate and temperature respectively of the water delivered to the outlet 241. The control valve may be of any suitable type and may be thermostatic or non-thermostatic as well known to those skilled in the art.

Between the ends of the valve body 239 there are two inlet connectors 251, 253 that extend normal to the longitudinal axis of the valve body for attaching the mixing valve 201 to the mounting plate 203 and for connecting the mixing valve 201 to the supply pipes 209, 211. Each inlet connector 251, 253 is similar and one connector will now be described with reference to FIGS. 10 and 14, it being understood that the description applies to the other connector.

The inlet connector 251 has a first end portion 255 that is fixed relative to the valve body 239 and a second end portion 257 that is rotatable relative to the first end portion 255 about the longitudinal axis of the connector 251. An O-ring 259 provides a fluid tight seal between telescopically engaged parts of the end portions 255, 257 and a collar 261 axially retains the second end portion 257 relative to the first end portion 255.

The second end portion 257 has an external screw thread 263 towards the free end for engagement with the internal screw thread 229 of the boss 213. The second end portion 257 has a through bore with an internal annular groove 265 in a short cylindrical portion between the ends in which an O-ring (not shown) is located to provide a fluid tight seal with the outer surface of the supply pipe 209. The cylindrical bore portion leads to an outer end portion 267 that is tapered to increase in diameter towards the free end of the connector 251. In a modification (not shown), the outer end portion 267 may be cylindrical with a chamfer at the outer end similar to the modification of the previous embodiment shown in FIG. 8.

Figure 12:
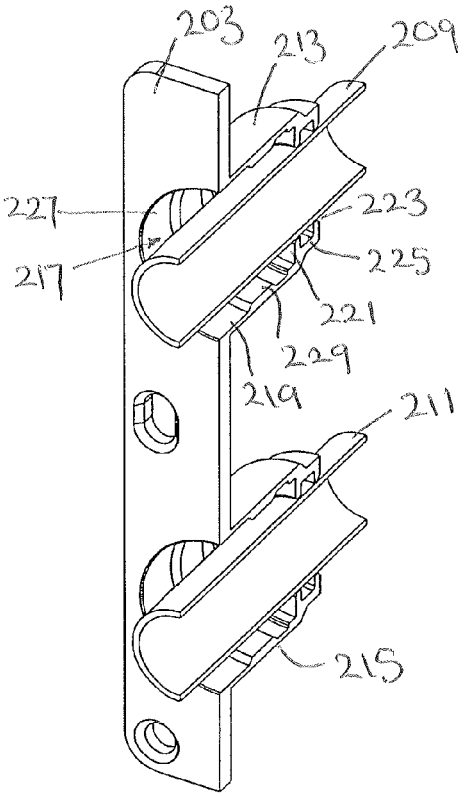
FIG. 12 is a perspective view, partly cut away, showing the mounting plate of FIG. 11 and the inlet pipes for connection to the mixing valve of FIG. 10.
Figure 13:
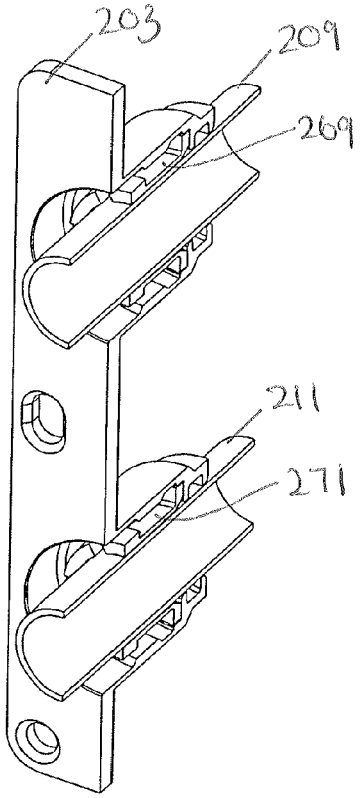
FIG. 13 is a perspective view, partly cut away, showing the mounting plate and inlet pipes of FIG. 12 with sleeves for retaining the inlet pipes.
Figure 14:
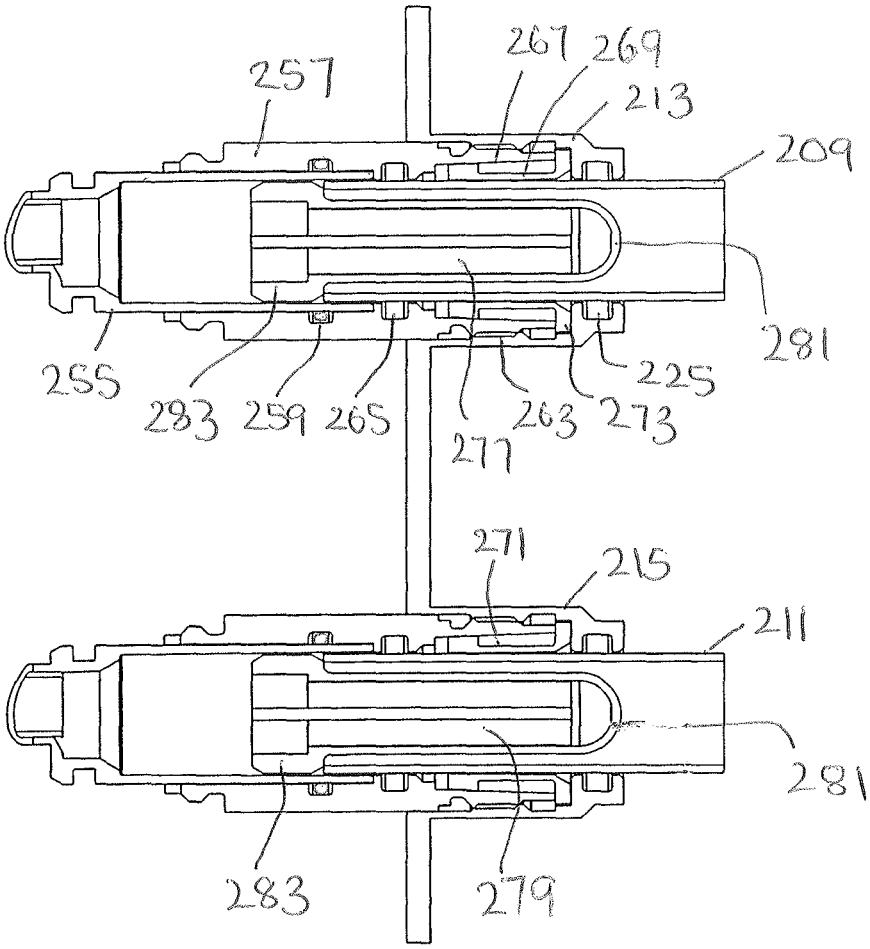
FIG. 14 is a sectional view, partly cut away, showing inlet connectors for the mixing valve of FIG. 10 connected to the mounting plate of FIG. 13.

During installation, the mounting plate 203 is fitted over the supply pipes 209, 211 and secured to the wall so that the pipes 209, 211 project from the mounting plate 203 (FIG. 12). If necessary the projecting length of the pipes 209, 211 can be reduced to allow fitment of the inlet connectors 251, 253. Sleeves 269, 271 are then fitted over the ends of the supply pipes 209, 211 and slid along the pipes 209, 211 into the annular gap 227 between the pipes 209, 211 and the bosses 213, 215. The sleeves 269, 271 are similar to the sleeves 159, 161 of the previous embodiment with a cylindrical body having an external flange 273 at one end and an external collar 275 at the other end that is split in the circumferential direction by a plurality of slots (not shown) that extend in the axial direction towards and terminate before the flange 273. The flange 273 is passed over the end of the supply pipe first when fitting the sleeves 269, 271.

Also during installation, the supply pipes 209, 211 are provided with filters 277, 279 similar to the filters 165, 167 of the previous embodiment with a tubular sieve portion 281 that is a clearance fit in the end of the supply pipe and a head portion 283 that is a close fit in the end of the supply pipe. The outer end of the head portion 283 is enlarged to be a radial tight fit in the inlet connector. As in the previous embodiment, the filters 277, 279 fit in the end of the supply pipes 209, 211 and are removable for cleaning, replacement.

With the sleeves 269, 271 and filters 277, 279 in place, the mixing valve 201 is presented to the mounting plate 203 to align the inlet connectors 251, 253 with the supply pipes 209, 211. The inlet connectors 251, 253 are then attached to the mounting plate 203 to connect the supply pipes 209, 211 to the mixing valve 201. Each connection is similar and one connection will now be described in more detail with reference to FIG. 14, it being understood that the description applies to the other connection.

The rotatable end portion 257 of the connector 251 is inserted into the gap 227 between the supply pipe 209 and boss 213 until the screw threads 229, 263 of the boss 213 and connector 251 engage whereupon the end portion 257 is rotated to secure the connector 251 to the mounting plate 203. The flange 273 of the sleeve 269 is located between the abutment shoulder 221 and the end of the inlet connector 251. The split collar 275 of the sleeve 269 is received in the tapered bore portion 267 of the inlet connector 251 and co-operates with the tapered bore portion 267 as the end portion 257 of the connector 251 is screwed into the boss 213 causing the sleeve 269 to be compressed radially inwards to grip the supply pipe 209 and prevent the supply pipe 209 being pushed back into the wall.

As a result, the axial relationship between the sleeve 269 and the supply pipe 209 does not change as inlet connector 251 is screwed into the mounting plate 203 and the gripping force increases as the sleeve 269 extends further into the inlet connector 251 due to the taper of the bore portion 267. In this way, the supply pipe 209 is firmly secured and retained within the inlet connector 251. In the installed position, the O-ring located in the groove 265 of the inlet connector 251 provides a first or main fluid-tight seal with the outer surface of the supply pipe 209 and the O-ring located in the groove 225 of the boss 213 provides a second or back-up fluid-tight seal with the outer surface of the supply pipe 209.

If any fluid leaks past the main seal, the back-up seal prevents fluid passing back along the supply pipe 209 through the holes in the support surface where such leakage may not visible. Instead any leakage of fluid will tend to work its way forwards between the mounting plate and the connector to appear on the outside of the support surface so as to be visible and allow appropriate remedial action to be taken before appreciable damage is caused within the wall and the adjacent structure of the building. It will be understood that the supply pipe 211 is likewise firmly secured and retained in a fluid-tight manner within the other inlet by a similar arrangement.

When it is desired to remove the mixing valve 201, the inlet connectors 251, 253 can be unscrewed from the bosses 213, 215 and the valve 201 detached from the mounting plate 203. The compression of the sleeves 269, 271 is reduced as the connectors 251, 253 are unscrewed.

When the valve 201 is detached from the mounting plate 203, the sleeves 269, 271 can be slid-off the pipes 209, 211 allowing the mounting plate 203 to be removed by releasing the screws attaching the mounting plate 203 to the wall and leave the ends of the supply pipes 209, 211 projecting from the wall for mounting another mixing valve. By the use of sleeves to secure and retain the supply pipes 209, 211 in place when the mixing valve 201 is installed, removal and replacement of the mixing valve 201 is facilitated.

Figure 15:
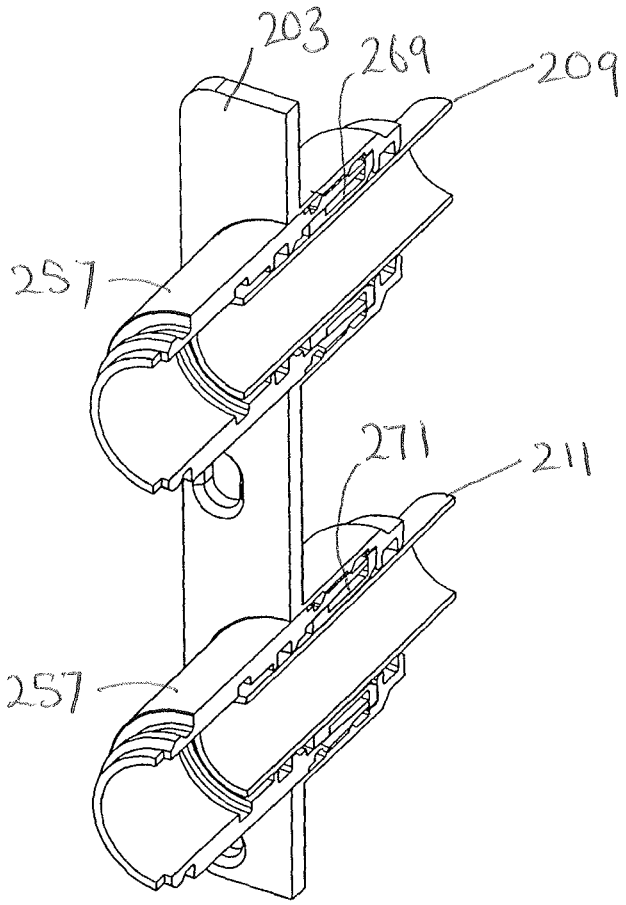
FIG. 15 is a perspective view, partly cut away, of the inlet connections for installation of the mixing valve of FIG. 10.
Figure 16:
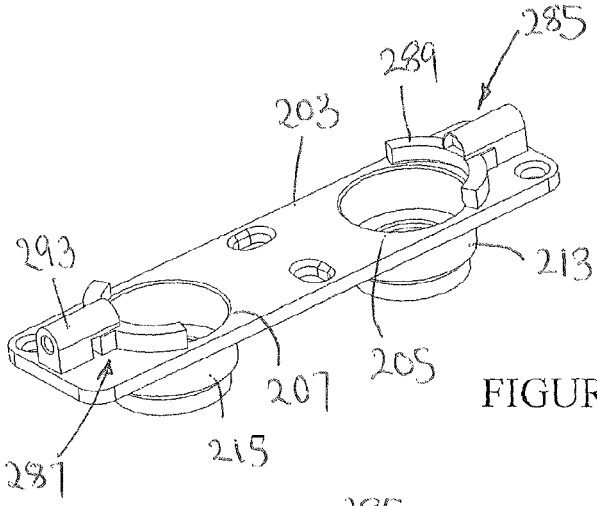
FIG. 16 is a perspective view showing a modification to the mounting plate of FIG. 11.
Figure 17:
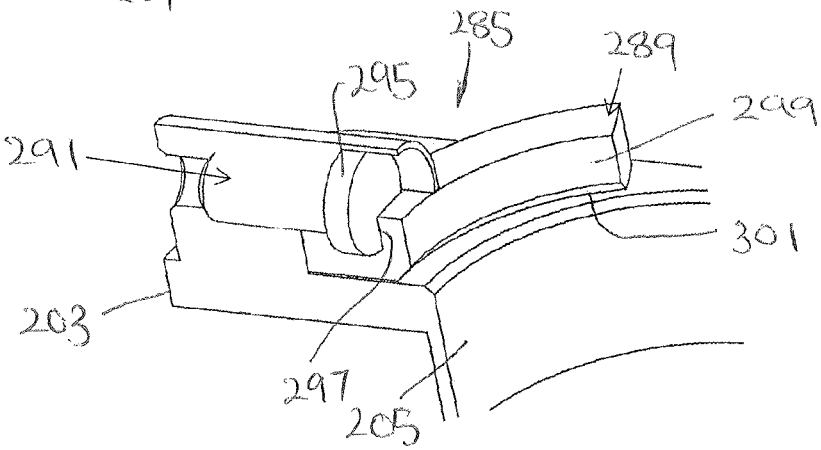
FIG. 17 shows a detail of the one of the clamps shown in FIG. 16.
Figure 18:
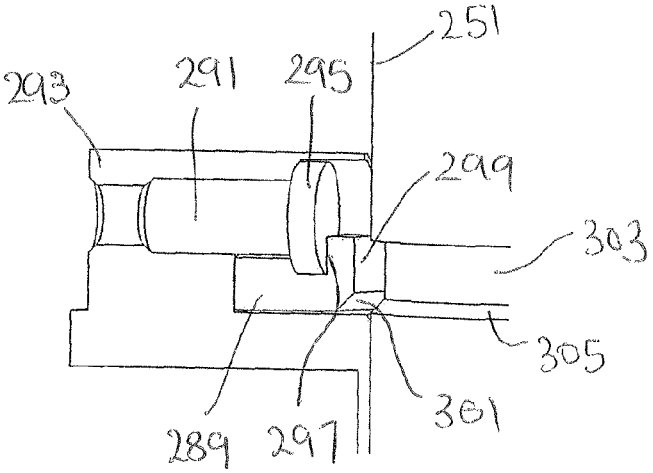
FIG. 18 shows a detail of the engagement between the clamp of FIG. 17 and an inlet connector.
Figure 19:
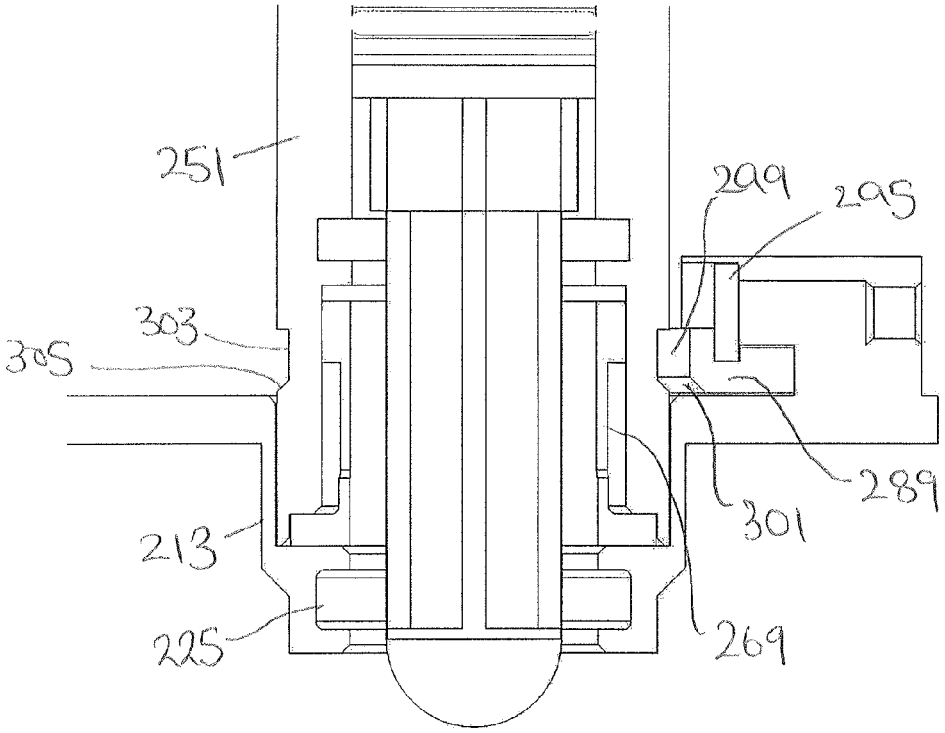
FIG. 19 is a sectional view, showing the engagement between the clamp and inlet connector of FIG. 18.
Figure 20:
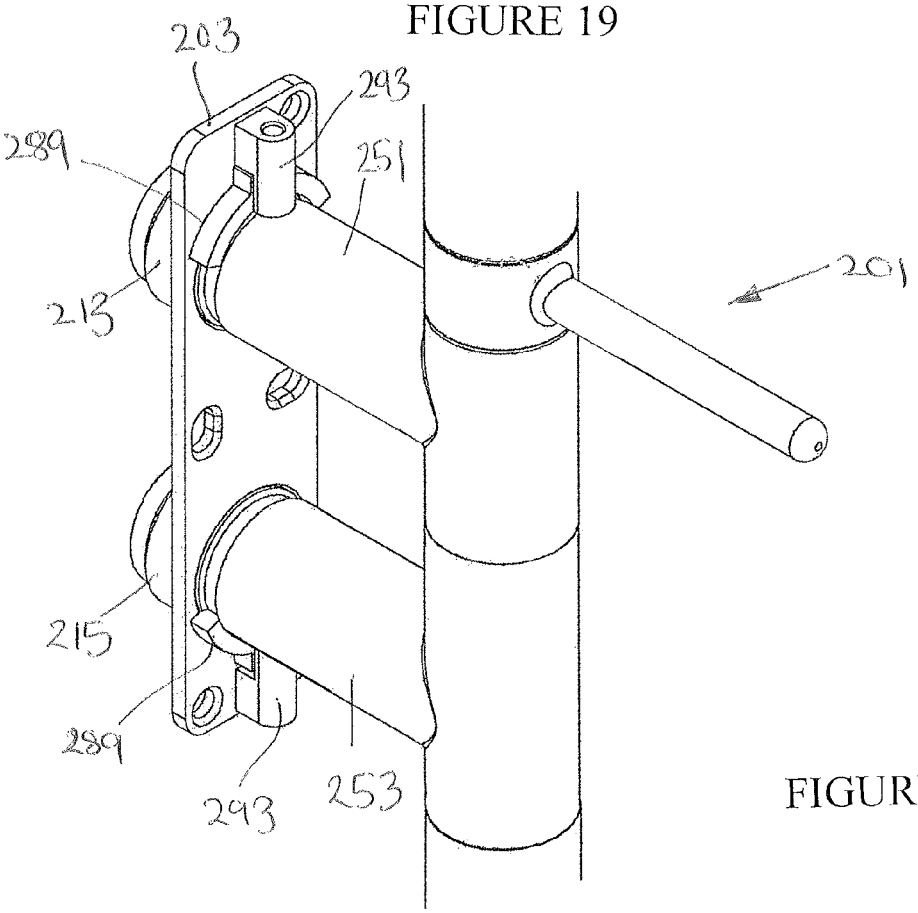
FIG. 20 is a perspective view, partly cut away, showing the mixing valve connected to the mounting plate of FIG. 16

FIG. 15 shows a modification to the above described method, in which the outer end portions 257 of the inlet connectors 251, 253 are detached from the valve and screwed into the mounting plate 203 to secure the pipes 209, 211. The valve 201 is then presented to the mounting plate 203 to engage the end portions 255, 257 of the inlet connectors 251, 253 and axially retain the outer end portions 257 by means of the sleeves 269, 271 to secure the mixing valve 201 to the mounting plate 203. The valve 201 can be removed by a reverse procedure, for example for servicing or access to the filters.

Referring now to FIGS. 16 to 20, there is shown an alternative method for securing the mixing valve 201 to the mounting plate 203, in which like reference numerals are used to indicate corresponding parts.

As shown, the mounting plate 203 is provided with a pair of clamps 285, 287 mounted on the front of the mounting plate 203 adjacent to the marginal edge of the apertures 205, 207 for co-operating with the inlet connectors 251, 253 of the mixing valve 201. The clamps and connectors are similar and one clamp and connector will now be described in more detail, it being understood that the description applies to the other clamp and connector.

The clamp 285 includes a clip 289 of generally C-shape to extend partly around the aperture 205 and a grub screw 291 for adjusting the position of the clip 289 relative to the aperture 205. The clip may be made of plastics or other materials such as elastomers or metals.

The grub screw 291 is threadably engaged within a housing 293 and has an enlarged head 295 at one end that is located in a channel 297 on the clip 289. The other end of the grub screw 291 is accessible through the housing to insert a tool (not shown) for rotating the grub screw 291 to adjust the axial position of the grub screw 291 and move the clip 289 in a radial direction relative to the aperture 205. The clip 289 has an internal side face 299 provided with an angled surface or chamfer 301 on the underside adjacent to the mounting plate 203.

The inlet connector 251 is a unitary component attached at one end to the valve body 239. The screw threads on the connector 251 and boss 213 described above are omitted and the other end of the connector 251 is a push-fit in the boss 213. The connector 251 has an annular groove 303 in the outer surface provided on one side with an angled surface or chamfer 305 that matches the chamfer 301 on the clip 289.

In use, the clamp 285 is adjusted by means of the grub screw 291 to withdraw the clip 289 and provide clearance for the connector 251 to be inserted into the boss 213 to compress the sleeve 269 and grip the end of the supply pipe as described previously. The connector 251 can be inserted until the groove 303 is aligned with the clip 289. The grub screw 289 is then adjusted to advance the clip 289 towards the connector 251 so that the chamfer 301 on the clip 289 engages the chamfer 305 on the connector 251. The engagement of the chamfers 301, 305 pulls the connector 251 down tight on the mounting plate 203 and secures the connector 251 to the mounting plate 203. The other connector 253 is secured in similar manner.

The connectors 251, 253 may be permanently attached to the valve body 239 or may be detachable. Where the connectors 251, 253 are detachable, the valve body 239 may be attached to the connectors 251, 253 before or after the connectors 251, 253 are attached to the mounting plate 203. The valve body can be removed by a reverse procedure. In other respects, the construction and operation of this mixing valve and mounting plate is the same as the embodiment of FIGS. 10 to 14 and may include any of the modifications thereof.

As will be appreciated from the description of the exemplary embodiments, the invention enables a mixing valve to be connected to and disconnected from hot and cold water supply pipes without the use of compression joints employing olives that are fixed to the pipes when the joints are assembled. The inlets of the mixing valve and sleeves co-operate to clamp the pipes in position and the clamping force is released when the valve is detached allowing the sleeves to be slid off of the pipes and the mounting plate to be detached from the wall.

While the invention has been described with reference to particular embodiments, it will be understood that the invention is not limited thereto and that the invention has application for installation of other types of mixing valves. Furthermore, the invention may have application to other installations requiring a releasable fluid connection between a supply pipe and a fitting, for example a tap.

Moreover, it will be understood that the exemplary embodiments are not limiting on the scope of protection and that the principles and concepts described herein can be provided in different forms with the same or equivalent means for achieving the desired result. All such forms of the invention and means for achieving same are within the scope of the invention.

Additionally or alternatively, features and/or modifications of any of the embodiments described herein may be employed separately or in combination with features and/or modifications of any other embodiment.

The invention claimed is:

1. A mixing water valve assembly comprising:

supply pipes for hot and cold water;

a mixing valve having inlets wherein each inlet is configured to receive one of the supply pipes;

a mounting plate for securing to a support surface such that the supply pipes extend through the mounting plate for reception in the inlets, wherein the mixing valve is releasably connectable to the mounting plate; and sleeves positionable on the supply pipes for reception in the inlets;

wherein the sleeves are slidingly positionable on the supply pipes;

wherein each of the sleeves is positioned on a supply pipe and is configured for insertion into the associated inlet along with the supply pipe such that upon insertion, the sleeve compresses to grip and secure the supply pipe in the inlet; and wherein the sleeves and mounting plate is removable from the supply pipes when the mixing valve is detached from the mounting plate.

2. The assembly of claim 1, wherein the sleeves are configured to release a grip on the supply lines when the mixing valve is detached from the mounting plate; and wherein the sleeves is removable from the supply pipes together with the mounting plate.

3. The assembly according to claim 1, wherein each sleeve is separate from the mounting plate and comprises a cylindrical body with an external flange at one end that locates against the mounting plate;

and wherein the body is received in and co-operates with the inlet to secure the supply pipe.

4. The assembly according to claim 1, wherein each sleeve is integral with the mounting plate and comprises a cylindrical body that is received in and co-operates with the inlet to secure the supply pipe.

5. The assembly according to claim 1, wherein the inlets are provided within a valve body and joined to the associated supply pipes by a push-fit;

wherein a fluid-tight seal is provided within the inlets, between the supply pipes and the valve body; and wherein the valve body is releasably secured to the mounting plate such that the valve body conceals the mounting plate.

6. The assembly according to claim 1, wherein each inlet is provided within an inlet connector and is joined to the associated supply pipe by a push-fit; and wherein a fluid-tight seal is provided within each inlet, between the associated supply pipe and inlet connector.

7. The assembly according to claim 6, wherein the inlet connectors are releasably attached to the mounting plate and are rotatable relative to a valve body to attach and detach the valve body.

8. The assembly according to claim 1, wherein the inlets are in the form of bores of uniform cross-section.

9. The assembly according to claim 1, wherein the inlets are in the form of bores that increase in cross-section towards an outer end thereof.

10. The assembly according to claim 1 wherein each sleeve defines a plurality of slots extending axially along the sleeve; and wherein the slots are configured to compress such that the sleeve grips the associated supply pipe.

11. A method of connecting supply pipes for hot and cold water to inlets of a mixing valve, the method comprising:

providing a mixing valve having inlets for supply pipes;

providing a mounting plate with holes for passage of the supply pipes;

sliding a sleeve on a projecting end of each supply pipe attaching the mounting plate to a support surface such that the supply pipes pass through the holes and project from the associated projecting ends of the supply pipes;

inserting each projecting end of the supply pipes into the associated inlet such that the sleeves co-operate with the inlets in response to reception in the inlets to compress the sleeves to grip and secure the pipes in the inlets; and releasably connecting the mixing valve to the mounting plate;

wherein the sleeves and mounting plate is removable from the pipes when the mixing valve is detached from the mounting plate.

12. The method according to claim 11 wherein the sleeve is decompressed when the inlets are detached from the supply pipes, allowing the sleeves to be slid off the pipes and the mounting plate removed.

13. The method according to claim 11 further comprising compressing a plurality of slots extending axially along each sleeve such that the sleeve grips the associated supply pipe.

* * * * *